US007513710B2

(12) United States Patent
Demozzi et al.

(10) Patent No.: US 7,513,710 B2
(45) Date of Patent: Apr. 7, 2009

(54) SPACER FOR ROAD OR MOTORWAY CRASH BARRIER

(75) Inventors: Andrea Demozzi, Trento (IT); Massimo Eccel, Gardolo (IT); Vittorio Giavotto, Milan (IT)

(73) Assignee: Provincia Autonoma Di Trento, Trento (IT)

( * ) Notice: Subject to any disclaimer, the term of this patent is extended or adjusted under 35 U.S.C. 154(b) by 0 days.

(21) Appl. No.: 10/570,401

(22) PCT Filed: Aug. 25, 2004

(86) PCT No.: PCT/IB2004/002768

§ 371 (c)(1),
(2), (4) Date: Nov. 15, 2006

(87) PCT Pub. No.: WO2005/021873

PCT Pub. Date: Mar. 10, 2005

(65) Prior Publication Data

US 2007/0098489 A1 May 3, 2007

(30) Foreign Application Priority Data

Sep. 2, 2003 (IT) ..... MI2003A1691

(51) Int. Cl.
*E01F 15/00* (2006.01)

(52) U.S. Cl. ..... 404/6; 404/9; 256/13.1

(58) Field of Classification Search ..... 404/6, 404/9; 256/13.1

See application file for complete search history.

(56) References Cited

U.S. PATENT DOCUMENTS 2,056,858 A * 10/1936 Eck et al. ..... 256/13.1
2,927,513 A * 3/1960 Dove ..... 256/13.1
3,262,240 A * 7/1966 Schuman et al. ..... 52/704
3,276,750 A * 10/1966 De Ridder ..... 256/13.1
3,493,213 A * 2/1970 Ackerman ..... 256/13.1
4,075,473 A * 2/1978 Winston ..... 256/13.1
4,090,694 A * 5/1978 Vincent ..... 256/13.1
5,069,576 A * 12/1991 Pomero ..... 404/6
5,195,727 A * 3/1993 Liao et al. ..... 256/13.1
5,219,241 A * 6/1993 Picton ..... 404/6
5,468,093 A * 11/1995 Voigt ..... 404/6
5,507,473 A * 4/1996 Hammer et al. ..... 256/13.1

(Continued)

FOREIGN PATENT DOCUMENTS

FR 2817572 6/2002

OTHER PUBLICATIONS

PCT International Search Report and Written Opinion for Application No. PCT/IB2004/002768.

(Continued)

*Primary Examiner*—Raymond W Addie
(74) *Attorney, Agent, or Firm*—Sheridan Ross P.C.

(57) ABSTRACT

A new type of spacer (1) for road or motorway crash barrier is described, consisting of an elastic body (2), fixed by means of bolts (4) or of other known fixing means to the supporting posts (5) of the crash barrier, which is integral with means (3) for supporting the longitudinal beam (6) belonging to the crash barrier. Preferably, the elastic body (2) is a rubber body with trapezoidal section and the means (3) for supporting the longitudinal beam (6) are connected to the rubber body (2) by vulcanization.

7 Claims, 2 Drawing Sheets

U.S. PATENT DOCUMENTS 5,720,470 A * 2/1998 Johansson ..... 256/13.1
6,036,399 A * 3/2000 Schalk ..... 404/6
6,168,346 B1 1/2001 Ernsberger
6,530,560 B2 * 3/2003 King ..... 256/1
6,583,211 B1 6/2003 Wayts
6,637,971 B1 * 10/2003 Carney et al. ..... 404/6
6,706,132 B2 * 3/2004 Coffin ..... 156/87
2002/0094235 A1 7/2002 King
2003/0228191 A1 * 12/2003 King ..... 404/6

OTHER PUBLICATIONS

PCT International Preliminary Report of Patentability for PCT/IB2004/003768.

* cited by examiner

SPACER FOR ROAD OR MOTORWAY CRASH BARRIER

The present invention refers to a new type of spacer for a road or motorway crash barrier —positioned between the supporting posts and the longitudinal beam belonging to the crash barrier—which is particularly suitable to deform elastically and plastically to absorb the energy in the event of a collision with the crash barrier.

Currently in road or motorway crash barriers the spacer—i.e. the element that connects one of the supporting posts to the longitudinal beam (or strip) of the crash barrier—consists of a metal body and the various elements of the crash barrier are joined by means of bolts.

The spacer is designed to deform elastically and plastically during the impact thus facilitating the retaining function of the crash barrier; the most innovative systems deform by moving the longitudinal beam upwards.

Subject matter of the present invention is a new type of spacer, which differs from the traditional spacers at least in that the method of connecting the spacer and the longitudinal beam, the technology used in the crash barrier assembly and, preferably, the material constituting the spacer are different.

Said new type of spacer has the characterising features illustrated in claim 1; further advantageous characteristics of the spacer are subject matter of the dependent claims.

The spacer will now be described with reference to a non-restrictive embodiment described in the attached drawings, where:

In the attached drawings the corresponding elements will be identified by the same numerical references.

Figure 1:
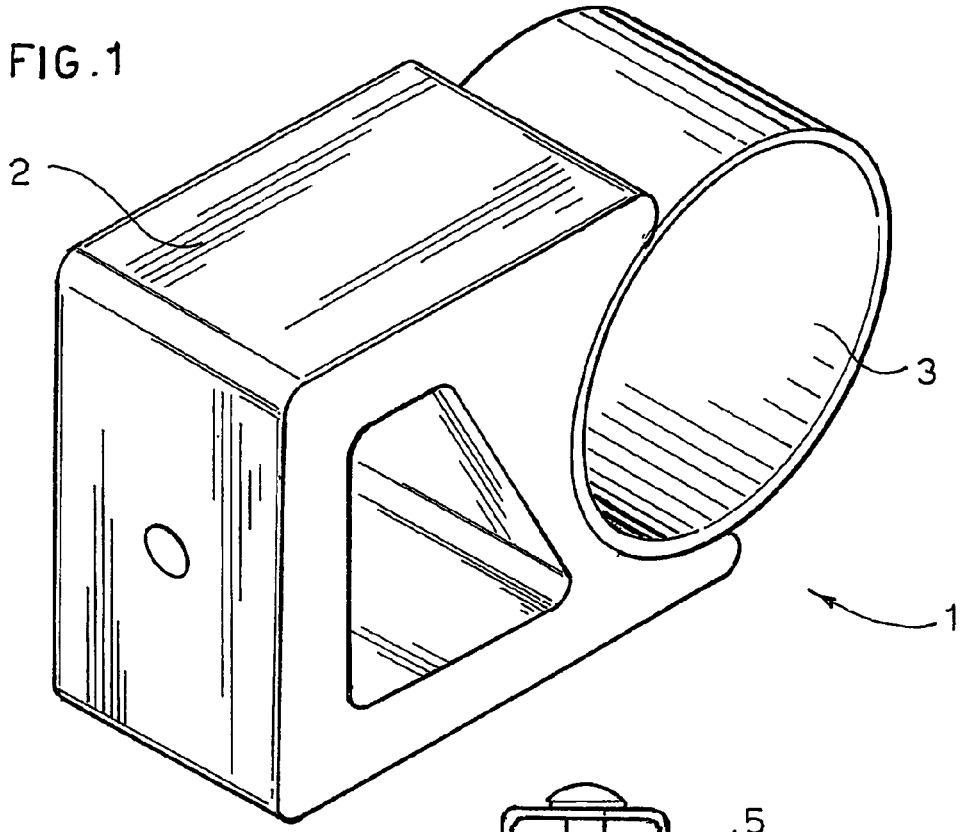
FIG. 1 shows a perspective view of a spacer realised according to the invention.

FIG. 1 shows a perspective view of a spacer realised according to the invention—indicated overall by reference 1—which comprises an elastic body 2, fixed to one of the supporting posts 5 (FIG. 2) of the crash barrier, integral with means 3 designed to support the longitudinal beam 6 (FIG. 2) belonging to the crash barrier.

Preferably the elastic body 2 is made of rubber since it has been ascertained experimentally that said material guarantees an elastic return for low energy impacts, not obtainable with the usual steel spacers, permitting an optimisation of maintenance work.

The rubber body 2 illustrated in FIG. 1 gives the spacer 1 good elastic reaction to the impact and, due to its trapezoidal section, it facilitates an upward deformation of the longitudinal beam 6.

Without departing from the scope of the invention, the section of the rubber body 2 does not necessarily have to be trapezoidal and can be chosen each time to better satisfy the specific requirements of a particular installation.

Advantageously the means 3 which bear the longitudinal beam 6 are connected to the rubber body 2 via a vulcanisation process which guarantees an adequate adhesion but, without departing from the scope of the invention, the means 3 can be connected to the rubber body 2 via any other known joining process suitable for the purpose.

Again without departing from the scope of the invention, if a greater stiffness is required to the crash barrier the elastic body 2 can consist of a steel element bearing the means 3 which support the longitudinal beam 6.

In the embodiment described here, the means 3 consist of a tubular element which permits an easy insertion of the spacer 1 along the longitudinal beam 6—consisting of a tube with a circular section and an external diameter slightly smaller than the internal diameter of the tubular element 3—with the tubular element 3 running outside the longitudinal beam 6.

It has been experimentally ascertained that said method of connecting the spacer 1 and longitudinal beam 6 is—or can be—advantageous since the spacer 1 is not rigidly constrained to the longitudinal beam 6 but can run freely along it, simplifying installation and distributing the mechanical stress due to impact between two or more supporting posts 5: this permits—or can permit—a reduction of the section of the posts 5 (reducing their cost) without affecting the reliability and the efficiency of the crash barrier.

Figure 2:
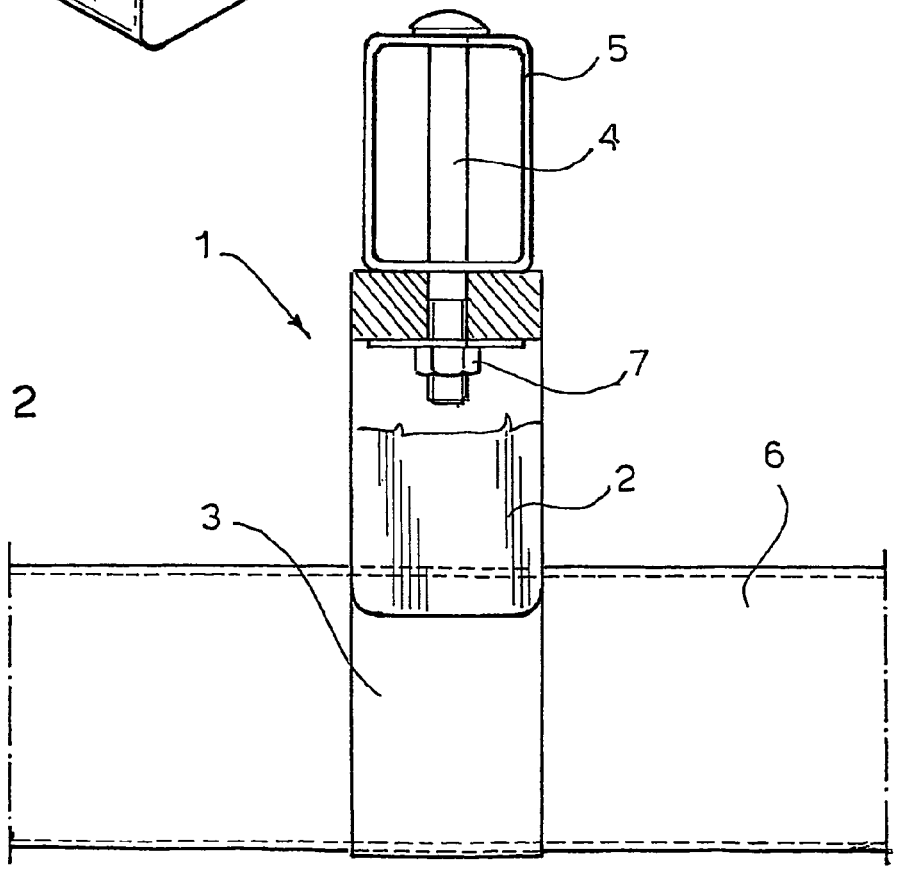
FIG. 2 shows schematically a top view of the spacer of FIG. 1, fixed to a supporting post bearing the longitudinal beam.

FIG. 2 shows schematically a top view of the spacer 1 fixed to a supporting post 5 of the crash barrier by means of a bolt 4 which crosses the section of the post 5 and the inner wall of the elastic body 2 and which is kept in place by means of a nut 7 or of other functionally equivalent fixing means; without departing from the scope of the invention, it is possible to replace the bolt 4 and the nut 7 with other functionally equivalent known fixing means.

In FIG. 2 the elastic body 2 has been partially sectioned to show the nut 7 and the portion of the bolt 4 inside the elastic body 2.

In the embodiment described in FIGS. 1 and 2, the means 3 designed to support the longitudinal beam 6 consist of a tubular element and the beam consists of a steel tube but, without departing from the scope of the invention, it is possible to realise the longitudinal beam 6 by means of an element with a section different from the circular one (for example, the "multiple wave" section—normally a "double wave" or a "triple wave" section—which is widely used in road and motorway crash barriers) by using means 3 having a section complementary to that of the beam 6.

Figure 3:
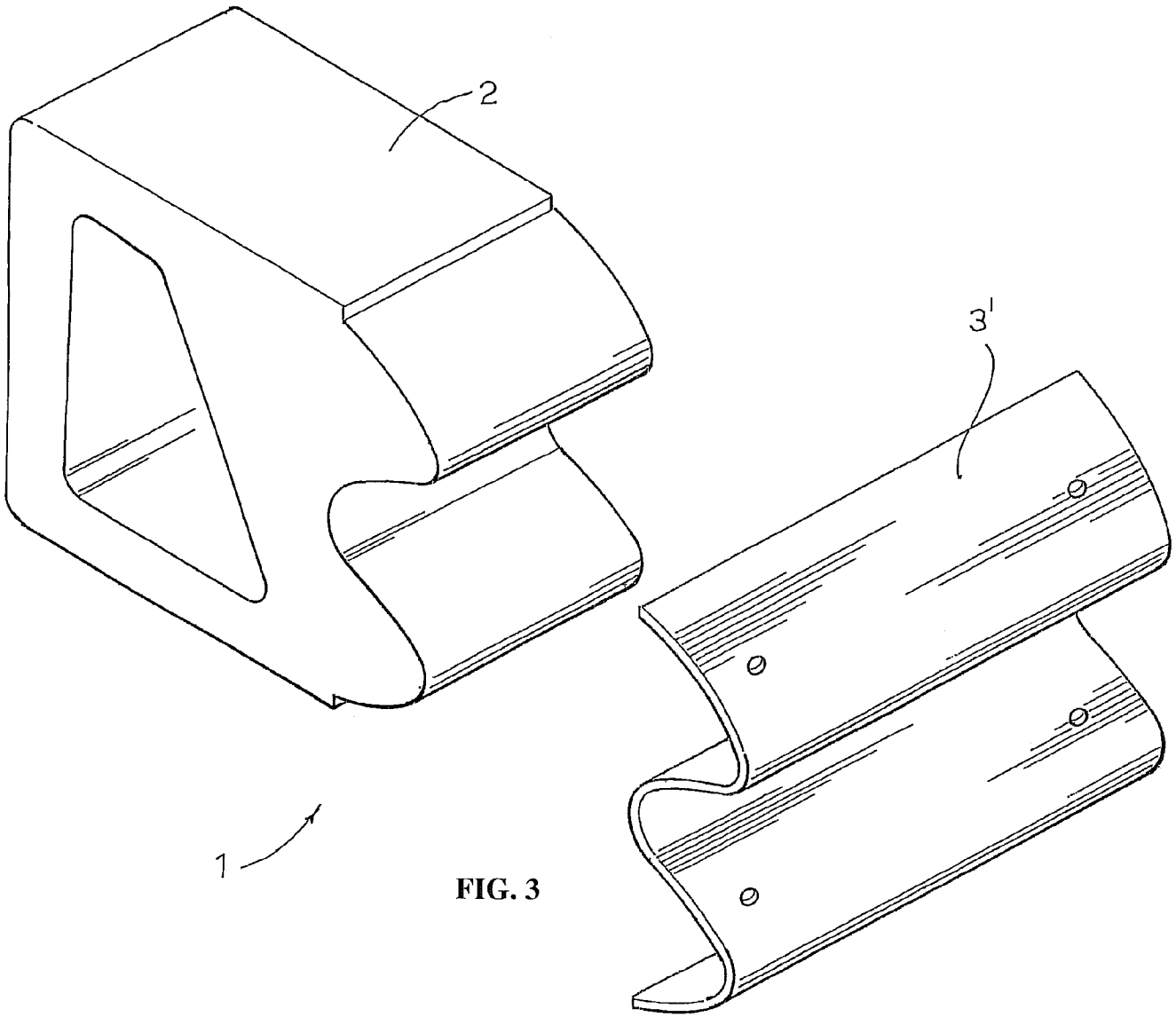
FIG. 3 shows a perspective view of a further spacer realised according to the invention.

FIG. 3 shows a perspective view of a spacer realised according to the invention, which differs from that shown in FIGS. 1 and 2 basically in that it is designed to support a longitudinal beam 6 with a "double wave" section.

For said purpose, the outer surface of the rubber body 2 has a "double wave" profile integral with means 3', having a "double wave" section, designed to support the "double wave" longitudinal beam 6.

The means 3' are connected to the rubber body 2 (preferably) by means of a vulcanisation process but, without departing from the scope of the invention, the means 3' can be connected to the rubber body 2 by means of any other known joining process suitable for the purpose.

Without departing from the scope of the invention, it is possible for a skilled person to make any modifications or improvements to the spacer for crash barrier to which the present invention refers, on the basis of his experience and in line with the natural development in technology.

The invention claimed is:

1. A spacer for road or motorway crash barrier, comprising;

an elastic body, comprised of rubber, fixed to one of a plurality of supporting posts that are operatively associated with a crash barrier, said spacer comprising a single hollow, trapezoidal section that is asymmetrical about a vertical cross-sectional axis of said spacer, and wherein said spacer is rendered integral by vulcanization with a means for holding a longitudinal beam associated with said crash barrier;

wherein said means for holding said longitudinal beam comprises a tubular element, wherein said longitudinal beam further comprises a tube with a circular section and wherein said tubular element has an internal diameter that is larger than the external diameter of said longitudinal beam, said hollow trapezoidal section facilitates an upward deformation of the spacer body, during a collision, thereby attenuating vehicle impact forces.

2. The spacer as in claim 1, wherein said spacer is not rigidly constrained to said longitudinal beam for distributing the mechanical stress between two or more supporting posts when an object impacts said motorway crash barrier.

3. A spacer for road or motorway crash barrier, comprising;

an elastic body, fixed to one of a plurality of supporting posts that are operatively associated with a crash barrier;

a longitudinal beam comprising a tube with a circular section;

said spacer rendered integral with a tubular element;

said tube with a circular section coupled to said tubular element for holding said longitudinal beam to said spacer;

said tubular element comprising an internal diameter that is larger than an external diameter of said longitudinal beam; and wherein said spacer comprises a single hollow section that is asymmetrical about a vertical cross-sectional axis of said spacer.

4. The spacer as in claim 3, wherein said spacer is rendered integral with said tubular element by vulcanization.

5. The spacer as in claim 3, wherein said elastic body is formed of a material with sufficient elasticity to allow said spacer to deform elastically and absorb the kinetic energy caused by an object impacting said motorway crash barrier.

6. The spacer as in claim 5, wherein said material is rubber.

7. The spacer as in claim 3, wherein said spacer further comprises a single trapezoidal section operatively associated with said elastic body to cause a generally upward deformation of said longitudinal beam when an object impacts said motorway crash barrier.

* * * * *